US009197337B2

(12) United States Patent
Wu et al.

(10) Patent No.: US 9,197,337 B2
(45) Date of Patent: Nov. 24, 2015

(54) WIRELESS SIGNAL TRANSMISSION DEVICE AND SIGNAL RECEIVER WITH A WAVE GUIDE INCLUDING A MEDIUM SHEET WITH FIRST AND SECOND SECTIONS HAVING DIFFERENT DIELECTRIC CONSTANTS

(75) Inventors: Ta-Jen Wu, Hsinchu (TW); Wen-Tsai Tsai, Hsinchu (TW); Wen-Chen Lan, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 485 days.

(21) Appl. No.: 13/549,288

(22) Filed: Jul. 13, 2012

(65) Prior Publication Data

US 2013/0115873 A1 May 9, 2013

(30) Foreign Application Priority Data

Nov. 8, 2011 (TW) ..... 100140659 A

(51) Int. Cl.
*H04H 40/90* (2008.01)
*H01P 1/17* (2006.01)
*H01Q 15/24* (2006.01)

(52) U.S. Cl.
CPC ..... *H04H 40/90* (2013.01); *H01P 1/17* (2013.01); *H01Q 15/242* (2013.01)

(58) Field of Classification Search
None
See application file for complete search history.

(56) References Cited

U.S. PATENT DOCUMENTS

2005/0146400 A1* 7/2005 Jan et al. ..... 333/137
2009/0027294 A1* 1/2009 Bourry et al. ..... 343/848
2014/0152404 A1* 6/2014 Kyhle ..... 333/21 A

FOREIGN PATENT DOCUMENTS

CN 2159614 Y 3/1994
CN 1642036 A 7/2005
CN 101087037 12/2007

* cited by examiner

*Primary Examiner* — Alejandro Rivero

(57) ABSTRACT

A wireless signal transmission device is provided. The wireless signal transmission device includes a reflective surface and a receiver. The reflective surface reflects a wireless signal. The receiver receives the wireless signal reflected. The receiver includes a receiver body, a wave guide, a transmission unit and a medium sheet. The wave guide includes an opening end and a connection end connected thereto. The transmission unit is disposed in the wave guide adjacent to the connection end for receiving the wireless signal. The medium sheet is disposed in the wave guide, wherein the medium sheet comprises a first section and a second section, the first section is adjacent to the transmission unit, the second section is adjacent to the opening end, the first section has a first dielectric constant, the second section has a second dielectric constant, and the first dielectric constant is smaller than the second dielectric constant.

15 Claims, 5 Drawing Sheets

WIRELESS SIGNAL TRANSMISSION DEVICE AND SIGNAL RECEIVER WITH A WAVE GUIDE INCLUDING A MEDIUM SHEET WITH FIRST AND SECOND SECTIONS HAVING DIFFERENT DIELECTRIC CONSTANTS

CROSS REFERENCE TO RELATED APPLICATIONS

This Application claims priority of Taiwan Patent Application No. 100140659, filed on Nov. 8, 2011, the entirety of which is incorporated by reference herein.

BACKGROUND OF THE INVENTION

1. Field of the Invention

The present invention relates to a wireless signal transmission device, and in particular relates to a wireless signal transmission device transmitting circular polarized signals.

2. Description of the Related Art

Conventional circular polarized satellite signal receivers are made by inserting a medium sheet into a linear polarized signal receiver to transform the linear polarized signal receiver into a circular polarized signal receiver. However, the medium sheet inserted in the polarized signal receiver reduces signal isolation (Cx-pol, which is defined by a ratio of Co-polarization to Cross-polarization) thereof, and the signal transmission efficiency of the conventional circular polarized satellite signal receiver is therefore poor.

BRIEF SUMMARY OF THE INVENTION

A wireless signal transmission device is provided. The wireless signal transmission device includes a reflective surface and a receiver. The reflective surface reflects a wireless signal. The receiver receives the wireless signal reflected from the reflective surface. The receiver includes a receiver body, a wave guide, a transmission unit and a medium sheet. The wave guide includes an opening end and a connection end, wherein the connection end is connected to the receiver body. The transmission unit is disposed in the wave guide adjacent to the connection end, wherein the transmission unit receives the wireless signal. The medium sheet is disposed in the wave guide, wherein the medium sheet comprises a first section and a second section, the first section is adjacent to the transmission unit, the second section is adjacent to the opening end, the first section has a first dielectric constant, the second section has a second dielectric constant, and the first dielectric constant is smaller than the second dielectric constant.

In the wireless signal transmission device of the embodiment of the invention, the first section adjacent to the transmission unit is made of PP, which has a lower dielectric constant. The Noise Factor of the wireless signal transmission device is therefore improved. The second section adjacent to the opening end is made of ABS, which has a higher dielectric constant. The signal isolation (Cx-pol) and signal transmission efficiency of the wireless signal transmission device is therefore improved. In one embodiment, the wireless signal transmission device improves high band (11.7 GHz~12.2 GHz) circular polarized signal transmission efficiency.

The Applicant discovered that by utilizing the PP made first section with a lower dielectric constant adjacent to the transmission unit and by utilizing the ABS made second section with higher dielectric constant adjacent to the opening end, the Noise Factor and the signal isolation (Cx-pol) of the wireless signal transmission device can be improved simultaneously.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
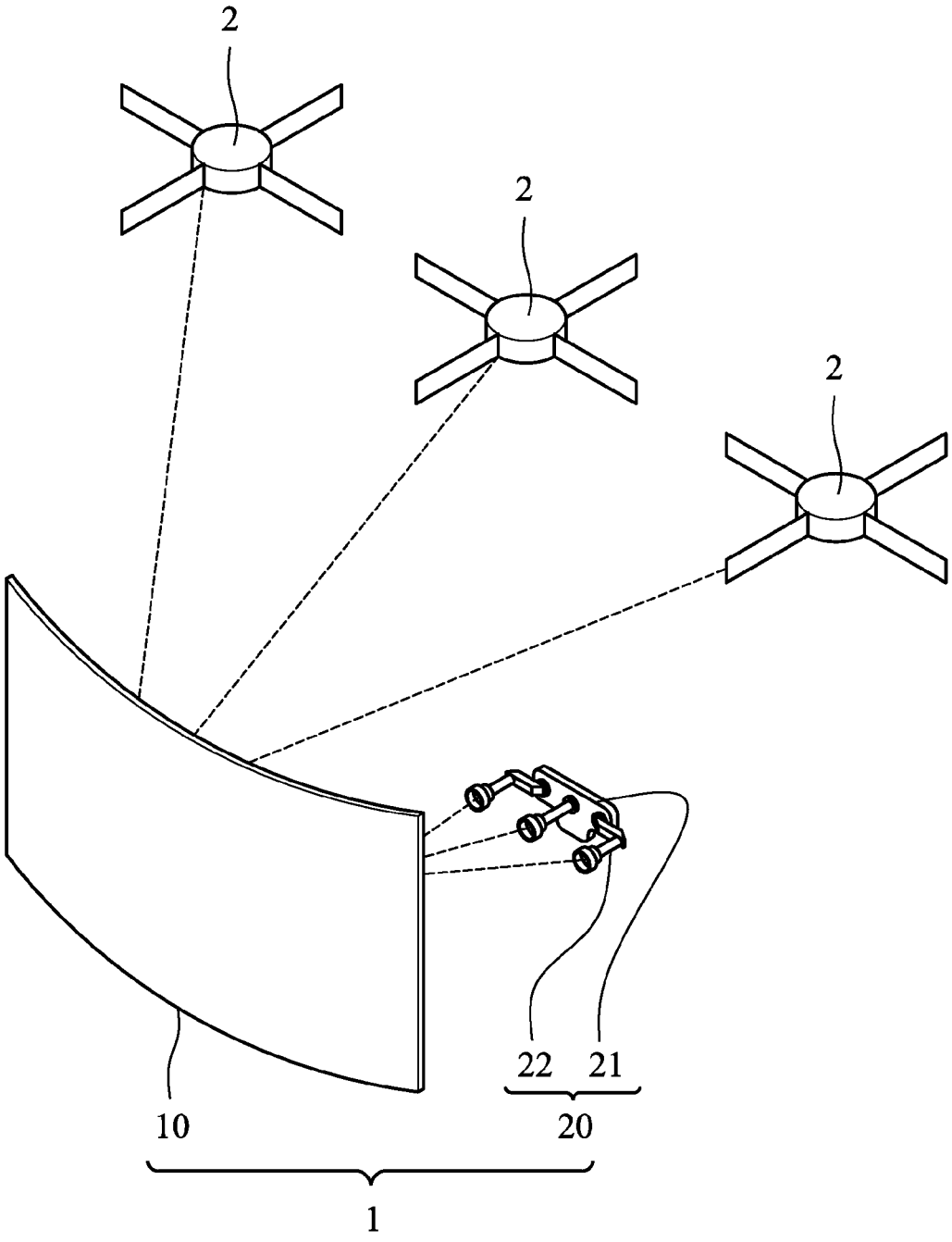
FIG. 1 shows the wireless signal transmission device of an embodiment of the invention.

FIG. 1 shows a wireless signal transmission device 1 of an embodiment of the invention. The wireless signal transmission device 1 receives circular polarized signals from satellites 2. The wireless signal transmission device 1 includes a reflective surface 10 and a signal receiver 20. The reflective surface 10 receives the circular polarized signals from the satellites 2, and reflects the circular polarized signals toward the receiver 20. The receiver 20 includes a receiver body 21 and a wave guide 22.

Figure 2:
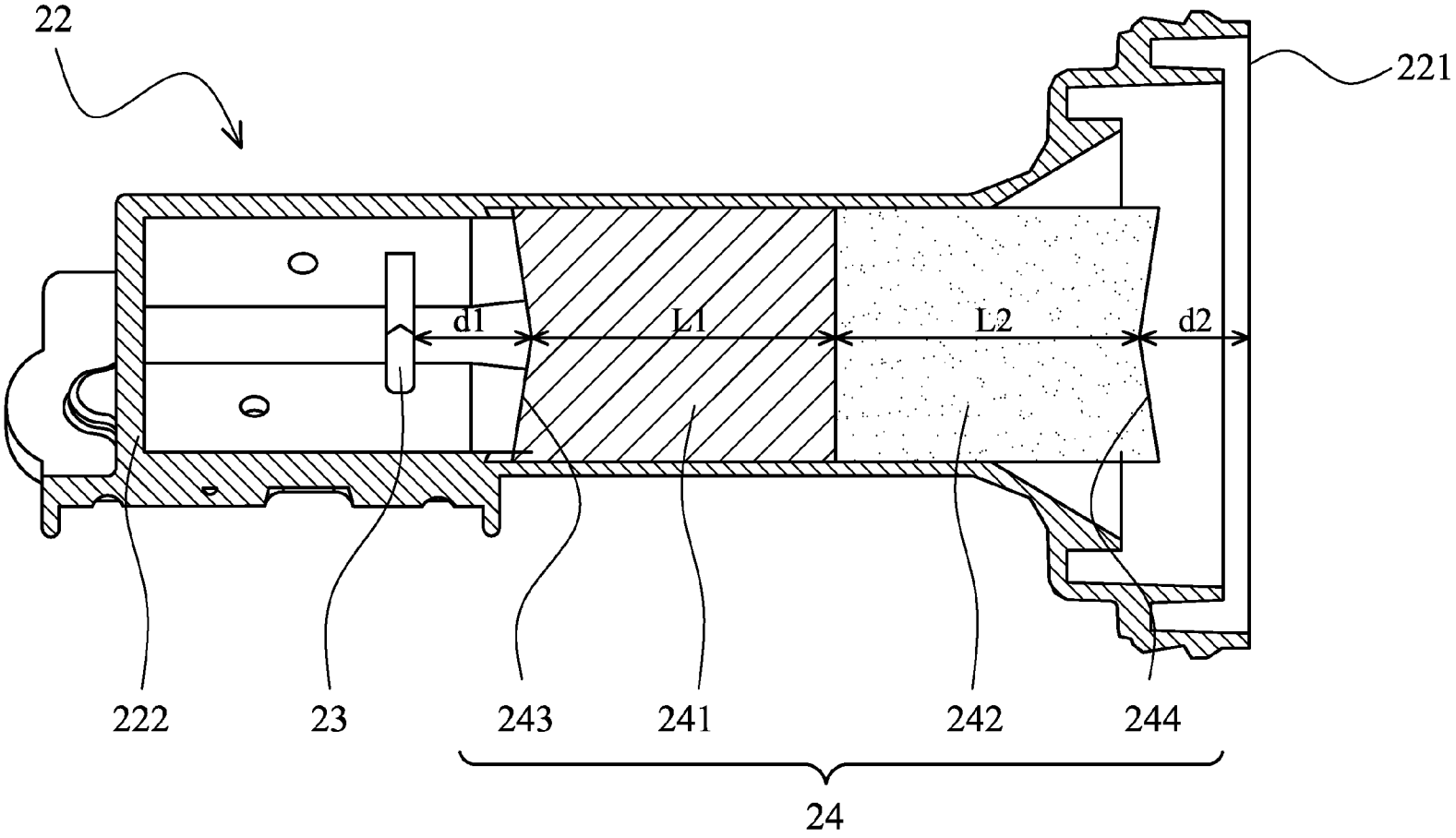
FIG. 2 shows the detailed structure inside the wave guide of the embodiment of the invention.

FIG. 2 shows the detailed structure inside the wave guide 22. A transmission unit 23 and a medium sheet 24 are disposed in the wave guide 22. The wave guide 22 comprises an opening end 221 and a connection end 222, wherein the connection end 222 is connected to the receiver body 21 (FIG. 1). The transmission unit 23 is disposed in the wave guide 22 adjacent to the connection end 222, wherein the transmission unit 23 receives the circular wireless signal. The medium sheet 24 is disposed in the wave guide 22, wherein the medium sheet 24 comprises a first section 241 and a second section 242, the first section 241 is adjacent to the transmission unit 23, the second section 242 is adjacent to the opening end 221, the first section 241 has a first dielectric constant, the second section 242 has a second dielectric constant, and the first dielectric constant is smaller than the second dielectric constant.

Figure 3:
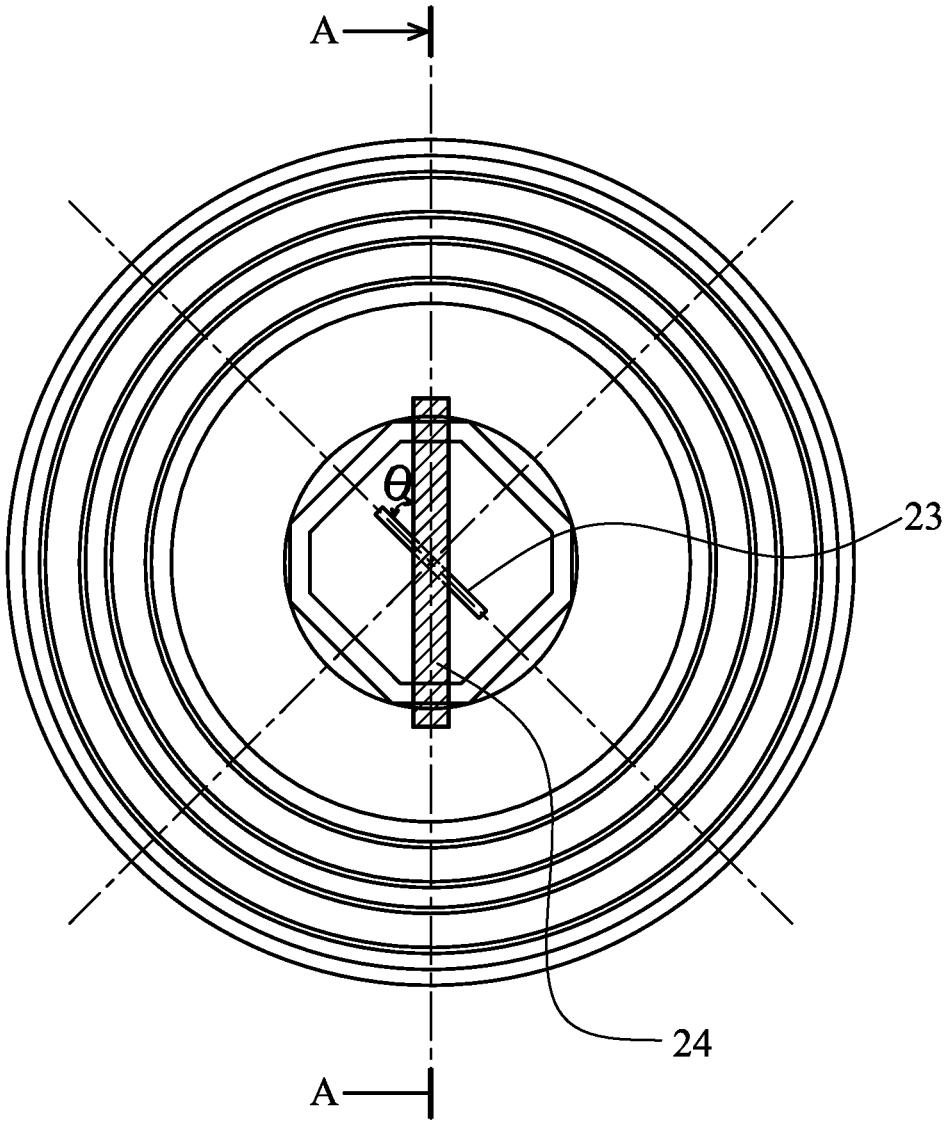
FIG. 3 is a front view of the wave guide of the embodiment of the invention.

FIG. 3 is a front view of the wave guide of the embodiment of the invention. The transmission unit 23 comprises a transmission pin (23). An included angle θ is formed between the medium sheet 24 and the transmission pin (extending direction), and the included angle θ is 45°.

With reference to FIG. 2, the first section 241 comprises polypropylene (PP), and the second section 242 comprises Acrylonitrile-Butadiene-Styrene (ABS).

In the wireless signal transmission device of the embodiment of the invention, the first section 241 adjacent to the transmission unit 23 is made of PP, which has a lower dielectric constant. The Noise Factor of the wireless signal transmission device is therefore improved. The second section 242 adjacent to the opening end 221 is made of ABS, which has a higher dielectric constant. The signal isolation (Cx-pol) and signal transmission efficiency of the wireless signal transmission device is therefore improved. In one embodiment, the wireless signal transmission device improves high band (11.7 GHz ~12.2 GHz) circular polarized signal transmission efficiency.

The Applicant discovered that by utilizing the PP made first section 241 with lower dielectric constant adjacent to the transmission unit 23 and by utilizing the ABS made second section 242 with higher dielectric constant adjacent to the opening end 221, the Noise Factor and the signal isolation (Cx-pol) of the wireless signal transmission device can be improved simultaneously. In one embodiment, when the difference between the first dielectric constant of the first section and the second dielectric constant of the second section is within the range of 0.5~1, transmission improvement is significant. In another embodiment, the difference between the first dielectric constant of the first section and the second dielectric constant of the second section can be 0.5, 0.8 or 1. After experimentation, when the difference between the first dielectric constant of the first section and the second dielectric constant of the second section is 1, an improved Xpol performance of the wireless signal transmission device can be achieved, for example, the first dielectric constant can be 2.3 and the second dielectric constant can be 3.3.

Figure 4:
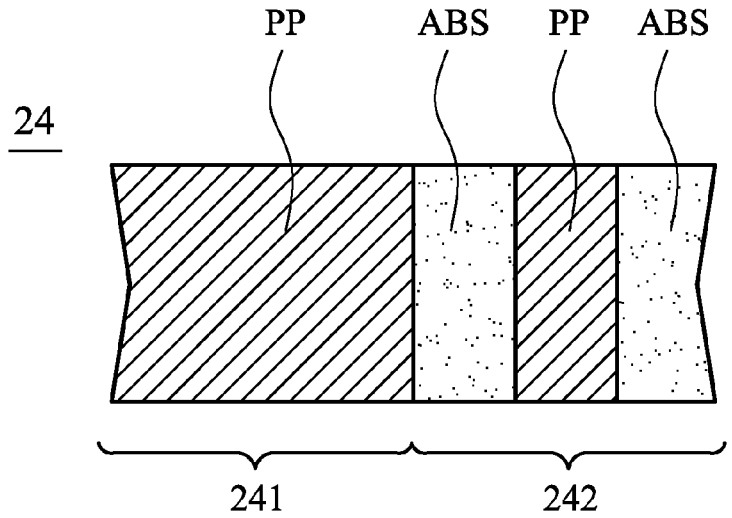
FIG. 4 shows the medium sheet of a modified embodiment of the invention.

In the embodiment above, PP and ABS are utilized in the medium sheet. However, the invention is not limited thereby. The material of the medium sheet can be changed for different transmission requirements. In a modified example, as shown in FIG. 4, the second section 242 can comprise PP and ABS simultaneously to satisfy particular transmission requirements.

With reference to FIG. 2, a length ratio of the length L1 of the first section to the length L2 of the second section is 1:1. The length ratio can be modified, for example, to a range of 1:0.8~1:1. After experimentation, when the length ratio of the length L1 of the first section to the length L2 of the second section is 1:1, improved Xpol performance of the wireless signal transmission device can be achieved.

The medium sheet 24 comprises a first end 243 and a second end 244, the first end 243 is toward the transmission unit 23, the second end 244 is toward the opening end 221 of the wave guide 22, a first distance d1 is formed between the first end 243 and the transmission unit 23, and a second distance d2 is formed between the second end 244 and the opening end 221 of the wave guide 22. In this embodiment, the first distance dl is about 6.5 mm~6.9 mm, and the second distance d2 about 9.5 mm~9.8 mm.

Figure 5:
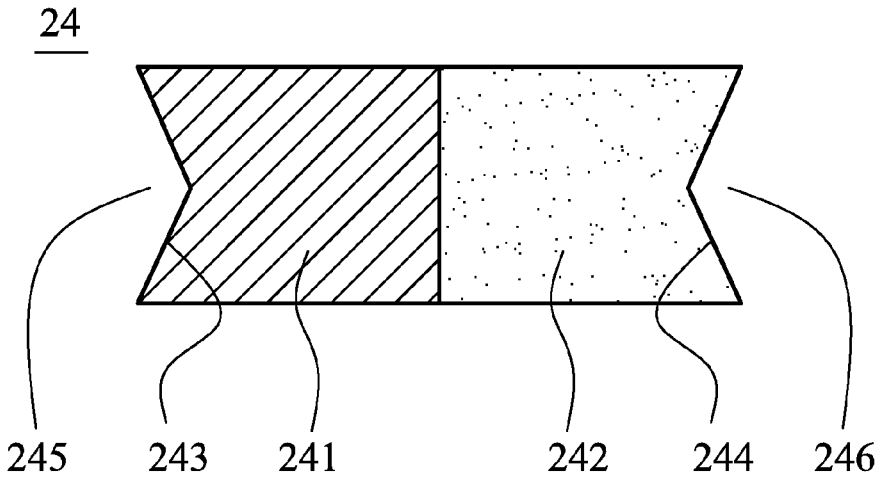
FIG. 5 shows the medium sheet of another modified embodiment of the invention.

With reference to FIG. 5, the shape of the medium sheet 24 can be modified, for example, a first notch 245 is formed on the first end 243, and a second notch 246 is formed on the second end 244. The first notch 245 and the second notch 246 can be triangular or other shaped.

Figure 6:
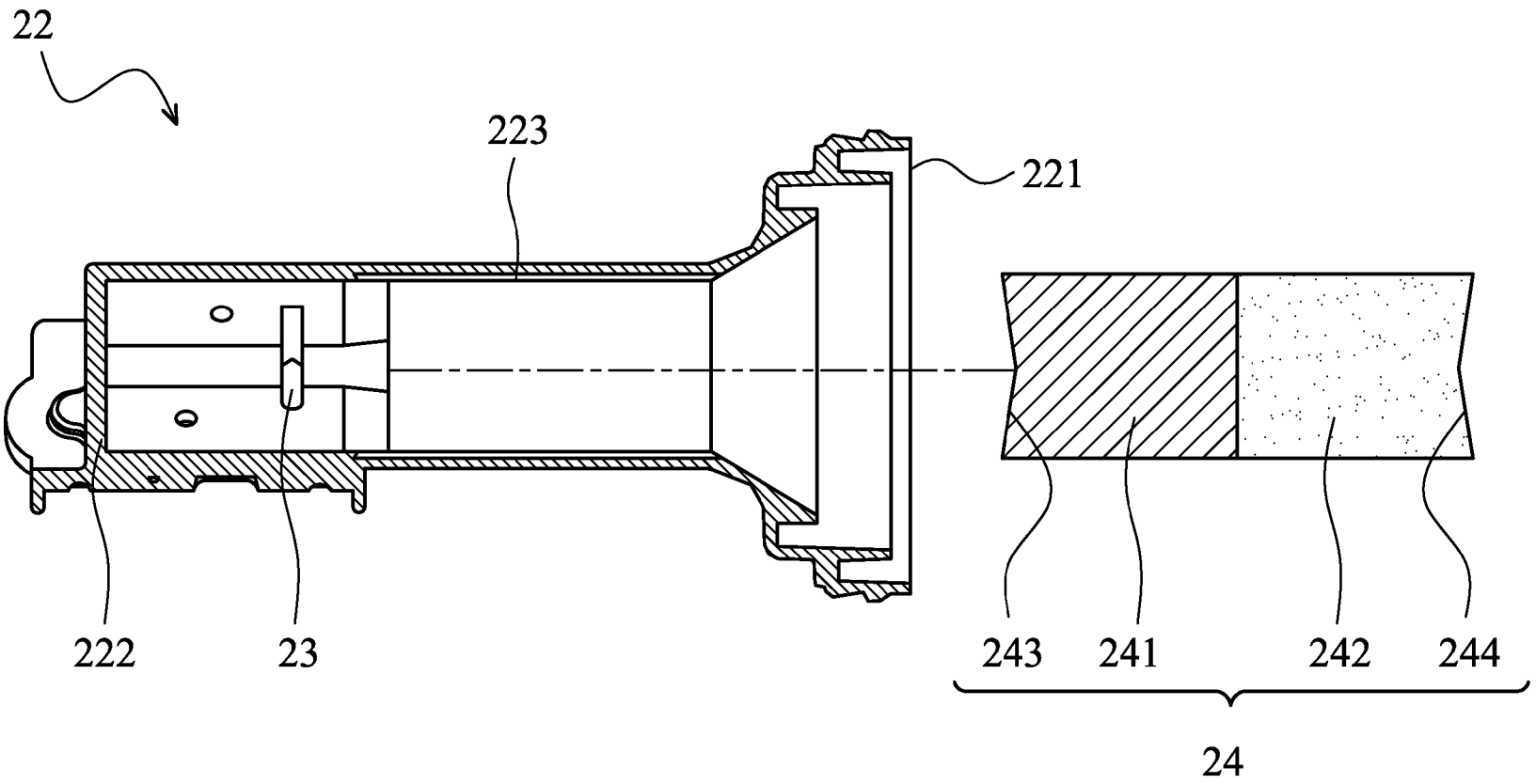
FIG. 6 shows the groove inside the wave guide of the embodiment of the invention.

With reference to FIG. 6, in one embodiment, the wave guide 22 comprises a groove 223, and the medium sheet 24 is slid in the groove 223 to be inserted into the wave guide 22. The orientation of the medium sheet 24 is fixed by the groove 223.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A wireless signal transmission device, comprising:
a reflective surface, reflecting a wireless signal; and
a receiver, receiving the wireless signal reflected from the reflective surface, comprising:
a receiver body;
a wave guide, comprising an opening end and a connection end, wherein the connection end is connected to the receiver body;
a transmission unit, disposed in the wave guide adjacent to the connection end, wherein the transmission unit receives the wireless signal; and
a medium sheet, disposed in the wave guide, wherein the medium sheet comprises a first section and a second section, the first section is adjacent to the transmission unit, the second section is adjacent to the opening end, the first section has a first dielectric constant, the second section has a second dielectric constant, and the first dielectric constant is smaller than the second dielectric constant, wherein the first section has only one dielectric constant, wherein the first section comprises polypropylene (PP), and the second section comprises Acrylonitrile-Butadiene-Styrene (ABS) and PP.

2. The wireless signal transmission device as claimed in claim 1, wherein the transmission unit comprises a transmission pin, an included angle is formed between the medium sheet and the transmission pin, and the included angle is 45°.

3. The wireless signal transmission device as claimed in claim 1, wherein a ratio of a length the first section to a length of the second section is between 1:0.8 and 1:1.

4. The wireless signal transmission device as claimed in claim 1, wherein the medium sheet comprises a first end and a second end, the first end is toward the transmission unit, the second end is toward the opening end of the wave guide, a first distance is formed between the first end and the transmission unit, and a second distance is formed between the second end and the opening end of the wave guide.

5. The wireless signal transmission device as claimed in claim 4, wherein the first distance is within a range of 6.5 mm-6.9 mm, and the second distance is within a range of 9.5 mm-9.8mm.

6. The wireless signal transmission device as claimed in claim 4, wherein a first notch is formed on the first end, and a second notch is formed on the second end.

7. The wireless signal transmission device as claimed in claim 1, wherein the wave guide comprises a groove, and the medium sheet is slid in the groove to be inserted into the wave guide.

8. The wireless signal transmission device as claimed in claim 1, wherein the wireless signal is a circular polarized signal.

9. A receiver, comprising:
a receiver body;

a wave guide, comprising an opening end and a connection end, wherein the connection end is connected to the receiver body;

a transmission unit, disposed in the wave guide adjacent to the connection end; and a medium sheet, disposed in the wave guide, wherein the medium sheet comprises a first section and a second section, the first section is adjacent to the transmission unit, the second section is adjacent to the opening end, the first section has a first dielectric constant, the second section has a second dielectric constant, and the first dielectric constant is smaller than the second dielectric constant, wherein the first section has only one dielectric constant, wherein the first section comprises polypropylene (PP), and the second section comprises Acrylonitrile-Butadiene-Styrene (ABS) and PP.

10. The receiver as claimed in claim 9, wherein the transmission unit comprises a transmission pin, an included angle is formed between the medium sheet and the transmission pin, and the included angle is 45°.

11. The receiver as claimed in claim 9, wherein a ratio of a length the first section to a length of the second section is between 1:0.8 and 1:1.

12. The receiver as claimed in claim 9, wherein the medium sheet comprises a first end and a second end, the first end is toward the transmission unit, the second end is toward the opening end of the wave guide, a first distance is formed between the first end and the transmission unit, and a second distance is formed between the second end and the opening end of the wave guide.

13. The receiver as claimed in claim 12, wherein the first distance is within a range of 6.5 mm-6.9 mm, and the second distance is within a range of 9.5 mm-9.8 mm.

14. The receiver as claimed in claim 12, wherein a first notch is formed on the first end, and a second notch is formed on the second end.

15. The receiver as claimed in claim 9, wherein the wave guide comprises a groove, and the medium sheet is slid in the groove to be inserted into the wave guide.

* * * * *